US005448679A

United States Patent [19]

McKiel, Jr.

[11] Patent Number: 5,448,679

[45] Date of Patent: Sep. 5, 1995

[54] METHOD AND SYSTEM FOR SPEECH DATA COMPRESSION AND REGENERATION

[75] Inventor: Frank A. McKiel, Jr., Trophy Club, Tex.

[73] Assignee: International Business Machines Corporation, Armonk, N.Y.

[21] Appl. No.: 999,509

[22] Filed: Dec. 30, 1992

[51] Int. Cl.[6] ..... G10L 9/00

[52] U.S. Cl. ..... 395/2.17; 395/2.23

[58] Field of Search ..... 395/2.17, 2.19, 2.23, 395/2.24, 2.28–2.32; 381/46

[56] References Cited

U.S. PATENT DOCUMENTS

| | | | |
|---|---|---|---|
| 4,461,024 | 7/1984 | Rengger et al. | 395/2.17 |
| 4,495,620 | 1/1985 | Steele et al. | 395/2.17 |
| 4,771,465 | 9/1988 | Bronson et al. | 395/2.17 |
| 4,817,155 | 3/1989 | Briar et al. | 395/2.17 |
| 4,916,742 | 4/1990 | Kolesnikov et al. | 395/2.24 |
| 5,293,449 | 3/1994 | Tzeng | 395/2.32 |
| 5,305,420 | 4/1994 | Nakamura et al. | 395/2.17 |

*Primary Examiner*—Allen R. MacDonald

*Assistant Examiner*—Michael A. Sartori

*Attorney, Agent, or Firm*—Jonathan E. Jobe; Andrew J. Dillon

[57] ABSTRACT

A method and system for creating a compressed data representation of a human speech utterance which may be utilized to accurately regenerate the human speech utterance. First, the location and occurrence of each period of silence, voiced sound and unvoiced sound within the speech utterance is detected. Next, a single representative data frame which may be repetitively utilized to approximate each voiced sound is iteratively determined, along with the duration of each voiced sound. The spectral content of each unvoiced sound, along with variations in the amplitude thereof is also determined. A compressed data presentation is then created which includes encoded representations of a duration of each period of silence, a duration and single representative data frame for each voiced sound and a spectral content and amplitude variations for each unvoiced sound. The compressed data representation may then be utilized to regenerate the speech utterance without substantial loss in intelligibility.

14 Claims, 3 Drawing Sheets

METHOD AND SYSTEM FOR SPEECH DATA COMPRESSION AND REGENERATION

BACKGROUND OF THE INVENTION

1. Technical Field

The present invention relates in general to methods and systems for speech signal data manipulation and in particular to improved methods and systems for compressing digital data representations of human speech utterances. Still more particularly, the present invention relates to a method and system for compressing digital data representations of human speech utterances utilizing the repetitive nature of voiced sounds contained therein.

2. Description of the Related Art

Modern communications and information networks often require the use of digital speech, digital audio and digital video. Transmission, storage, conferencing and many other types of signal processing for information, manipulation and display utilize these types of data. Basic to all such applications of traditionally analog signals are the techniques utilized to digitize those waveforms to achieve acceptable levels of signal quality for these applications.

A straightforward digitization of raw analog speech signals is, as those skilled in the art will appreciate, very inefficient. Raw speech data is typically sampled at anywhere from eight thousand samples per second to over forty-four thousand samples per second. Sixteen-to-eight bit companding and Adaptive Delta Pulse Code Modulation (ADPCM) may be utilized to achieve a 4:1 reduction in data size; however, even utilizing such a compression ratio the tremendous volume of data required to store speech signals makes voice-annotated mail, LAN-transmitted speech and personal computer based telephone answering and speaking software applications extremely cumbersome to utilize. For example, a one page letter containing two kilobytes of digital data might have attached thereto a voice message of fifteen seconds duration, which may occupy 160 kilobytes of data. Multimedia applications of recorded speech are similarly hindered by the size of the data required and are typically confined to high-density storage media, such as CD-ROM.

As a consequence of the large amounts of data required and the desirability of utilizing speech or digital audio within a data processing system numerous techniques have been proposed for compressing the digital data representation of speech signals. For example, International Business Machines Corporation Technical Disclosure Bulletin, July 1981, pages 1017–1018, discloses a technique whereby compression recording and expansion of asymmetrical speech waves may be accomplished. As described therein, the first cycle of each pitch period during a voiced sound period is utilized for compression and reconstruction of the speech. This technique is premised upon the observation that within most pitch periods the first one-fourth to one-fifth of the waveform is significantly larger in amplitude than subsequent portions of the waveform.

This first portion of the waveform is thought to contain nearly all of the frequency components that the remainder of the waveform contains and consequently only a fractional portion of the waveform is utilized for compression and reconstruction. When an unvoiced sound is encountered during a speech signal utilizing this technique one of two procedures are utilized. Either the unvoiced speech is digitized and stored in its entirety, or a single millisecond of sound along with the length of time that the unvoiced sound period lasts is encoded. During reconstruction the single sampled pitch period is replicated at decreasing levels of amplitude for a period of time equal to the voiced sound. While this technique represents an excellent data compression and reconstruction method it suffers from some loss of intelligibility.

Other techniques utilize high sampling rates to faithfully reproduce the random noise aspects of unvoiced speech; however, these techniques require substantial levels of data and do not take into account the essential qualities which determine speech intelligibility.

In view of the above, it should be apparent that a need exists for a method and system which may be utilized to efficiently compress speech and data and yet permit regeneration of that data without a substantial loss in speech intelligibility.

SUMMARY OF THE INVENTION

It is therefore one object of the present invention to provide an improved method and system for speech signal data manipulation within a data processing system.

It is another object of the present invention to provide an improved method and system for compressing digital data representations of human speech utterances within a data processing system.

It is yet another object of the present invention to provide an improved method and system for compressing digital data representations of human speech utterances within a data processing system which takes advantage of the repetitive nature of voiced sounds within human speech.

The foregoing objects are achieved as is now described. The method and system of the present invention may be utilized to create a compressed data representation of a human speech utterance which may be utilized to accurately regenerate the human speech utterance. First, the location and occurrence of each period of silence, voiced sound and unvoiced sound within the speech utterance is detected. Next, a single representative data frame which may be repetitively utilized to approximate each voiced sound is iteratively determined, along with the duration of each voiced sound. The spectral content of each unvoiced sound, along with variations in the amplitude thereof is also determined. A compressed data presentation is then created which includes encoded representations of a duration of each period of silence, a duration and single representative data frame for each voiced sound and a spectral content and amplitude variations for each unvoiced sound. The compressed data representation may then be utilized to regenerate the speech utterance without substantial loss in intelligibility.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
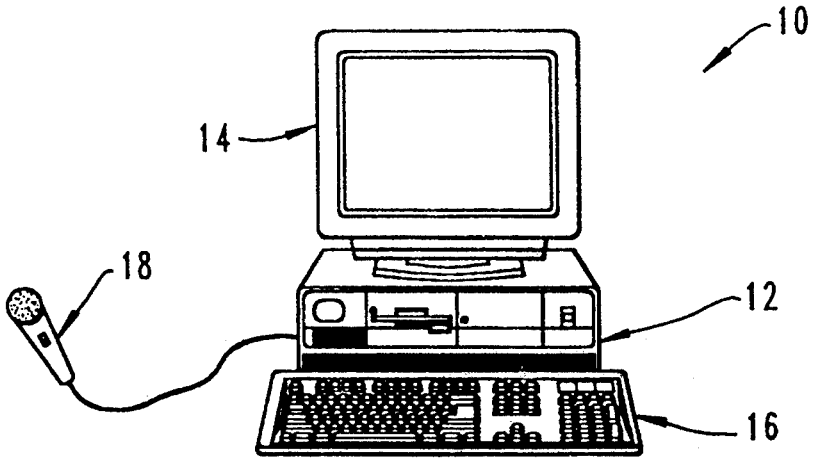
FIG. 1 is a, pictorial representation of a data processing system which may be utilized to implement the method and system of the present invention.

With reference now to the figures and in particular with reference to FIG. 1, there is depicted a pictorial representation of a data processing system 10 which may be utilized to implement the method and system of the present invention. As illustrated, data processing system 10 includes a processor unit 12, which is coupled to a display 14 and keyboard 16, in a manner well known to those having ordinary skill in the art. Additionally, a microphone 18 is depicted and may be utilized to input human speech utterances for digitization and manipulation, in accordance with the method and system of the present invention. Of course, those skilled in the art will appreciate that human speech utterances previously digitized may be input into data processing system 10 for manipulation in accordance with the method and system of the present invention by storing those utterances as digital representations within storage media, such as within a magnetic disk.

Data processing system 10 may be implemented utilizing any suitable computer, such as, for example, the International Business Machines Corporation PS/2 personal computer. Any suitable digital computer which can manipulate digital data in a manner described herein may be utilized to create a composed digital data representation of human speech and the regeneration of speech utterances, utilizing the method and system of the present invention, may be performed utilizing an add-on processor card which includes a digital signal processor (DSP) integrated circuit, a software application or a low-end dedicated hardware device attached to a communications port.

Figure 2:
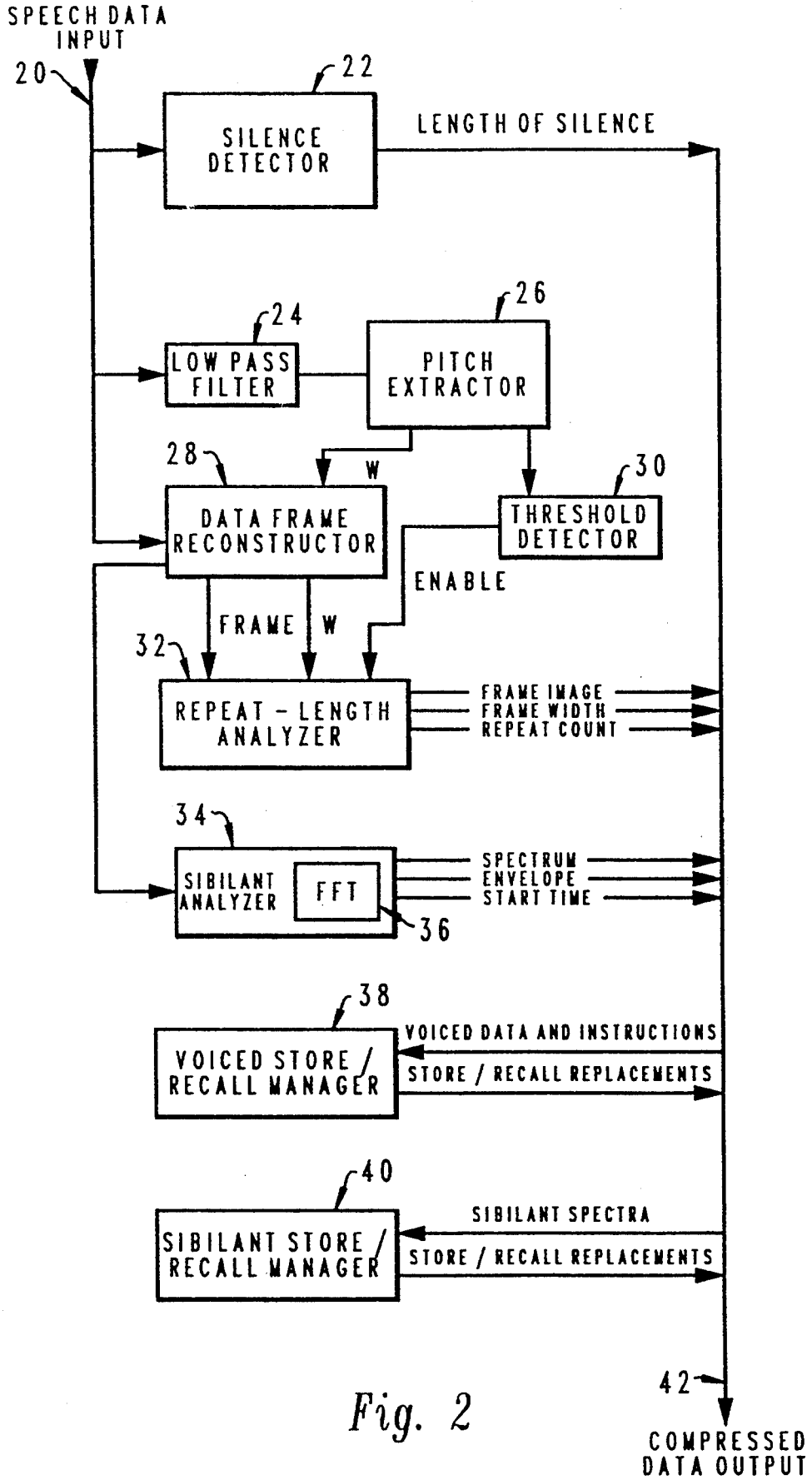
FIG. 2 high level data flow diagram of the process of creating a compressed digital representation of a speech utterance in accordance with the method and system of the present invention.

Referring now to FIG. 2, there is depicted a high level data flow diagram of the process of creating a compressed digital representation of a speech utterance, in accordance with the method and system of the present invention. As illustrated, a digital signal representation of the speech utterance is coupled to data input 20. Data input 20 is coupled to silence detector 22. In the depicted embodiment of the present invention silence detector 22 merely comprises a threshold circuit which generates an output indicative of a period of silence, if the signal at input 20 does not exceed a predetermined level.

The digitized representation of the speech signal is also coupled to low pass filter 24. Low pass filter 24 is preferably utilized prior to applying the digitized speech signal to pitch extractor 22 to ensure that phase-jitter among high amplitude, high frequency components do not skew the judgement of voice fundamental period within pitch extractor 26. The presence of a voiced sound within the speech utterance is then determined by coupling a threshold detector 30 to the output of pitch extractor 26 to verify the presence of a voiced sound and to permit a coded representation of the voiced sound to be processed, in accordance with the method and system of the present invention.

In a manner which will be explained in greater detail herein, pitch extractor 26 is utilized to identify a single representative data frame which, when utilized repetitively, most nearly approximates a voiced sound within a human speech utterance. This is accomplished by analyzing the speech signal applied to pitch extractor 26 and determining a frame width W for this representative data frame. As will be explained in greater detail below, this frame width W is determined iteratively by determining the particular frame width which results in a representative data frame which best identifies a repeating unit within each voiced sound. Next, the raw input speech signal is applied to representative data frame reconstructor 28 which utilizes the width information to construct an image of the single representative data frame which best characterizes each voiced speech sound, when utilized in a repetitive manner. It should be noted that the latter technique is applied to the raw speech signal which has not been filtered by low pass filter 24.

The output of representative data frame reconstructor 28, which consists of a representative frame and frame width, is then applied to repeat-length analyzer 32. Repeat-length analyzer 32 is utilized to process through the speech signal in a time-wise fashion, when enabled by the output of threshold detector 30, and to determine the number of representative data frames which must be replicated to adequately represent each voiced sound. The output of repeat-length analyzer 32 then consists of the image of the representative data frame, the width of that frame and the number of those frames which are necessary to replicate the current voiced sound within the speech utterance.

The residual signal output from representative data frame reconstructor 28 is applied to sibilant analyzer 34. Sibilant analyzer 34 is employed whenever there is a substantial residual signal from the pitch extraction/representative data frame construction procedure which indicates the presence of sibilant or unvoiced quantities within the speech signal. The unvoiced nature of sibilant sounds is generally characterized as a filtered white noise signal. Sibilant analyzer 34 is utilized to characterize sibilant or unvoiced sounds by detecting the start and stop time of such sounds and then performing a series of Fast Fourier transforms (FFT's), which are then averaged to analyze the overall spectral content of the unvoiced sound. Next, the unvoiced sound is subdivided into multiple time slots and the average amplitude of the signal within each time slot is summarized to derive an amplitude envelope. Thus, the output of sibilant analyzer 34 constitutes the spectral values of the unvoiced sound, the duration of the unvoiced sound and a sequence of amplitude values, which may be appended the output data stream to represent the unvoiced sound.

The process described above results in a compression output data stream which is created utilizing encoded representations of the duration of each period of silence, a duration and single representative data frame for each voiced sound and an encoded representation of the spectral content and amplitude envelope representative of each unvoiced sound. This process may be accomplished in a random data access process; however, the data may generally be processed in sequence, analyzing short segments of the speech signal in sequential order. The output of this process is an ordered list of data and instruction codes.

Further compression may be obtained by processing this output stream utilizing voiced store/recall manager 38 and sibilant store/recall manager 40. For example, voiced store/recall manager 38 may be utilized to scan the output stream for the presence of repeating unit images which may be temporarily catalogued within voiced store/recall manager 38. Thereafter, logic within voiced store/recall manager 38 may be utilized to decide whether waveform images may be replaced by recalling a previously transmitted waveform and applying transformations, such as scaling or phase shifting to that waveform. In this manner a limited number of waveform storage locations which may be available at the time of decompression may be efficiently utilized. Further, the output stream may be processed within voice store/recall manager 38 in any manner suitable for utilization with the decompression data processing system by modifying the output stream to replace the load instructions with store, recall and transformation instructions suitable for the decompression technique utilized.

Similarly, sibilant store/recall manager 40 may be utilized to analyze the output data stream for recurrent spectral data which may be stored and recalled in a similar manner to that described above with respect to voiced sounds. Typically, there are only four or five different sibilant spectra for an individual speaker, which greatly enhances the compression/decompression effectiveness.

Figure 3:
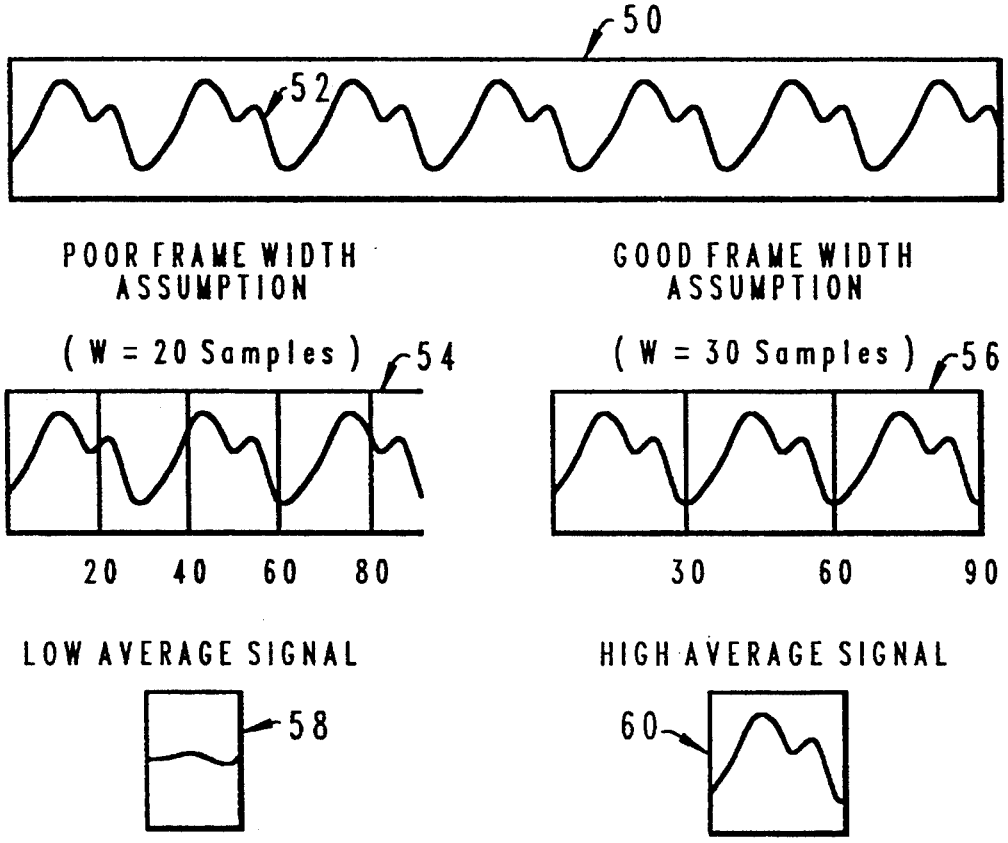
FIG. 3 is a pictorial representation of the process of analyzing a voiced sound in accordance with the method and system of the present invention.

With reference now to FIG. 3, there is depicted a pictorial representation of the process for analyzing a voiced sound, in accordance with the method and system of the present invention. As depicted, a voiced sound sample is illustrated at reference numeral 50 which includes a highly repetitive waveform 52. First, an assumed width for a representative data frame is selected. As depicted at reference numeral 54, when a poor assumption for the width of the representative data frame has been selected the waveform within each assumed frame differs substantially. The process proceeds by analyzing the input sample in consecutive frames of width W, and copying each waveform from within an assumed frame width into a sample space. Adjacent sections of the input sample are then averaged and, if the representative data frame width is poorly chosen, the average of consecutive data frames will reflect the cancellation of adjacent samples, in the manner depicted at reference numeral 58.

Referring again to input sample 50, if a proper assumption is selected for the width of the representative data frame, the signal present within each frame within the input sample will be substantially identical, as depicted at reference numeral 56. By repeatedly averaging the signal within each assumed data frame the result will be a high signal content, as depicted at block 60, indicating that a proper width for the representative data frame has been chosen. This process may be accomplished in a straightforward iterative fashion. For example, sixty-four different values of the representative data frame width may be chosen covering one octave, from eighty-six hertz to one hundred and seventy-two hertz. The effective resolution then ranges from 0.6 hertz to 2.6 hertz and an effective single representative data frame may be accurately chosen, by stepping through each possible frame width until such time as the averaging of signals within each frame results in a high signal content, as depicted at reference numeral 60 within FIG. 3.

Figure 4:
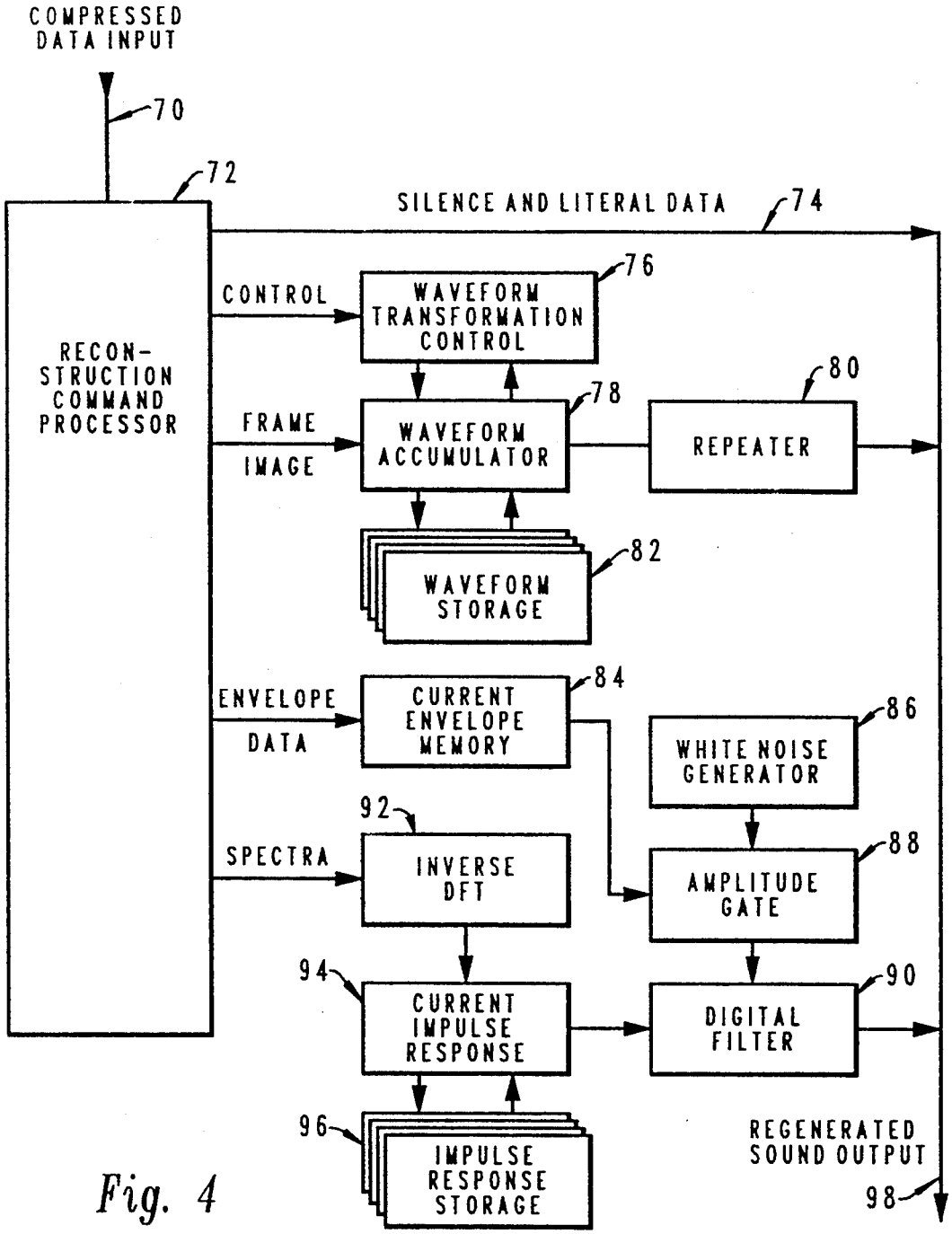
FIG. 4 is a high level data flow diagram of the process of regenerating a speech utterance in accordance with the method and system of the present invention.

Finally, referring to FIG. 4, there is depicted a high level data flow diagram of the procedure for regenerating a speech utterance in accordance with the method and system of the present invention. As illustrated, the regeneration algorithm operates upon the compressed data in a sequential manner. As the data and instructions within the compressed digital representation of the speech utterance are processed, it may be output immediately to a sound generator or stored as a sound data file. The compressed digital representation is applied at input 70 to reconstruction command processor 72. Reconstruction command processor 72 may be implemented utilizing data processing system 10 (see FIG. 1).

First, the reconstruction of voiced sounds will be described. The image of a representative data frame is applied to waveform accumulator 78. Waveform accumulator 78 utilizes waveforms which may be obtained from waveform storage 82 and thereafter outputs representative data frames through repeater 80. Waveform transformation control 76 is utilized to control the output of waveform accumulator 78 utilizing instructions such as: load waveform accumulator with the following waveform; repeat the content of waveform accumulator N times; store the content of waveform accumulator into a designated storage location; recall into the waveform accumulator what is in a designated storage location; rotate the content of waveform accumulator by N samples; scale the amplitude of waveform accumulator contents by a factor of S; enter zeros for N samples to recreate a period of silence; or, copy the data input literally from line 74. Those skilled in the art will appreciate that certain anomalous speech signals, such as plosives, may simply be digitized directly without encoding and regeneration of those waveforms is simply accomplished by regenerating directly from the digitized samples. Thus, utilizing the instructions described above, or additional instructions or variations of these instructions, a voiced sound may be regenerated in the manner described.

The regeneration of unvoiced speech, such as sibilant sounds, is accomplished utilizing a white noise generator 86 which is coupled through an amplitude gate 88 to a 64 point digital filter 90. Envelope data representative of amplitude variations within the unvoiced sound are applied to current envelope memory 84 and utilized to vary the amplitude gate 88. Similarly, the spectral content of the unvoiced sound is applied to inverse direct Fourier transform 92 to derive a 64 point impulse response, utilizing current impulse response circuit 94. This impulse response may be created utilizing stored impulse response data as indicated at reference numeral 96, and the impulse response is thereafter applied as filter coefficients to digital filter 90, resulting in an unvoiced sound which contains substantially the same spectral content and amplitude envelope as the original unvoiced speech sound.

Instructions for accomplishing the regeneration of unvoiced sounds within the input data may include: load a particular impulse response; load an envelope of length N; trigger the occurrence of a sibilant according to the current settings; store the current impulse response in an impulse response storage location; or, recall the current impulse response from a designated storage location.

Upon reference to the foregoing those skilled in the art will appreciate that the method and system of the present invention may be utilized to compress a digital data representation of a speech signal and regenerate speech from that compressed digital representation by taking advantage of the fact that the voiced portion of a speech signal typically consists of a repeating waveform (the vocal fundamental frequency and all of its phase-locked harmonics) which remains relatively stable for the duration of several cycles. This permits representation of each voiced speech sound as a single image of a repeating unit, with a repeat count. Subsequent voiced speech sounds tend to be slight modifications of previously voiced speech sounds and therefore, a waveform previously communicated and regenerated at the decompression end may be referenced and modified to serve as a new repeating unit image. These modifications to a previous image, which might include amplitude scaling, frequency scaling, or phase shifting are much more compactly encoded than a complete new digital waveform image.

Similarly, the unvoiced or sibilant portions of speech are essentially random noise which has been filtered by, at most, two different filters. By characterizing the spectral content and the amplitude envelope of an unvoiced speech sound the method and system of the present invention may be utilized to compress a digital representation of a speech signal and regenerate that signal into speech data with very little loss of intelligibility.

While the invention has been particularly shown and described with reference to a preferred embodiment, it will be understood by those skilled in the art that various changes in form and detail may be made therein without departing from the spirit and scope of the invention.

I claim:

1. A method for creating a compressed data representation of a human speech utterance which includes voiced sounds and unvoiced sounds, said method comprising the steps of:

detecting each occurrence of a voiced sound within said human speech utterance, analyzing each detected occurrence of a voiced sound within said human speech utterance to determine a duration thereof and a single representative data frame which when utilized repetitively most nearly approximates said voiced sound;

detecting each occurrence of an unvoiced sound within said human speech utterance;

analyzing each detected occurrence of an unvoiced sound within said human speech utterance to determine a spectral content thereof and amplitude variations therein;

creating a preliminary compressed data representation of said human speech utterance which includes an encoded representation of duration and a single representative data frame representative of each detected occurrence of a voiced sound and an encoded representation of a spectral content and amplitude variations representative of each detected occurrence of an unvoiced sound;

comparing portions of said preliminary compressed data representation of said human speech utterance with portions of previously created compressed data representations of human speech utterances which are stored at identified locations to determine if similarities exist; and creating a final compressed data representation of said human speech utterance which includes an identification of locations of similar portions of previously created compressed data representations of human speech utterances; an encoded representation of duration and a single representative data frame representative of each detected occurrence of a voiced sound which is not similar to a portion of a previously created compressed data representation of a human speech utterance; and, an encoded representation of a spectral content and amplitude variations representative of each detected occurrence of an unvoiced sound which is not similar to a portion of a previously created compressed data representation of a human speech utterance.

2. The method for creating a compressed data representation of a human speech utterance according to claim 1, wherein said human speech utterance includes periods of silence and wherein said method further includes the step of detecting each occurrence of a period of silence within said human speech utterance.

3. The method for creating a compressed data representation of a human speech utterance according to claim 2, further including the step of determining a duration of each detected occurrence of a period of silence.

4. The method for creating a compressed data representation of a human speech utterance according to claim 3, wherein said step of creating a compressed data representation of said human speech utterance further includes the step of including an encoded representation of said duration of each detected occurrence of a period of silence.

5. The method for creating a compressed data representation of a human speech utterance according to claim 1, wherein said step of analyzing each detected occurrence of a voiced sound within said human speech utterance to determine a duration thereof and a single representative data frame which when utilized repetitively most nearly approximates said voiced sound comprises the steps of:

determining a duration thereof;

assuming a width W for a single representative data frame; and, thereafter additively accumulating successive frames of width W of said voiced sound for various assumed widths until successive frames additively reinforce one another at a selected assumed width.

6. The method for creating a compressed data representation of a human speech utterance according to claim 1, wherein said step of analyzing each detected occurrence of an unvoiced sound within said human speech utterance to determine a spectral content thereof and amplitude variations therein comprises the steps of performing a series of Fourier transforms upon each detected occurrence of an unvoiced sound to determine a spectral content thereof and determining an average amplitude during each of a plurality of time frames within each detected occurrence of an unvoiced sound.

7. The method for creating a compressed data representation of a human speech utterance according to claim 1, further including the step of regenerating said human speech utterance utilizing said compressed data representation.

8. A system for creating a compressed data representation of a human speech utterance which includes voiced sounds and unvoiced sounds, said system comprising:

means for detecting each occurrence of a voiced sound within said human speech utterance;

means for analyzing each detected occurrence of a voiced sound within said human speech utterance to determine a duration thereof and a single representative data frame which when utilized repetitively most nearly approximates said voiced sound;

means for detecting each occurrence of an unvoiced sound within said human speech utterance;

means for analyzing each detected occurrence of an unvoiced sound within said human speech utterance to determine a spectral content thereof and amplitude variations therein;

means for creating a compressed data representation of said human speech utterance which includes an encoded representation of duration and a single representative data frame representative of each detected occurrence of a voiced sound and an encoded representation of a spectral content and amplitude variations representative of each detected occurrence of an unvoiced sound;

means for comparing portions of said preliminary compressed data representation of said human speech utterance with portions of previously created compressed data representations of human speech utterances which are stored at identified locations to determine if similarities exist; and means for creating a final compressed data representation of said human speech utterance which includes an identification of locations of similar portions of previously created compressed data representations of human speech utterances; an encoded representation of duration and a single representative data frame representative of each detected occurrence of a voiced sound which is not similar to a portion of a previously created compressed data representation of a human speech utterance; and, an encoded representation of a spectral content and amplitude variations representative of each detected occurrence of an unvoiced sound which is not similar to a portion of a previously created compressed data representation of a human speech utterance.

9. The system for creating a compressed data representation of a human speech utterance according to claim 8, wherein said human speech utterance includes periods of silence and wherein said system further includes means for detecting each occurrence of a period of silence within said human speech utterance.

10. The system for creating a compressed data representation of a human speech utterance according to claim 9, further including means for determining a duration of each detected occurrence of a period of silence.

11. The system for creating a compressed data representation of a human speech utterance according to claim 10, wherein said means for creating a compressed data representation of said human speech utterance further includes means for including an encoded representation of said duration of each detected occurrence of a period of silence.

12. The system for creating a compressed data representation of a human speech utterance according to claim 8, wherein said means for analyzing each detected occurrence of a voiced sound within said human speech utterance to determine a duration thereof and a single representative data frame which when utilized repetitively most nearly approximates said voiced sound comprises;

means for determining a duration thereof;

means for assuming a width W for a single representative data frame; and, means for thereafter additively accumulating successive frames of width W of said voiced sound for various assumed widths until successive frames additively reinforce one another at a selected assumed width.

13. The system for creating a compressed data representation of a human speech utterance according to claim 8, wherein said means for analyzing each detected occurrence of an unvoiced sound within said human speech utterance to determine a spectral content thereof and amplitude variations therein comprises means for performing a series of Fourier transforms upon each unvoiced sound to determine a spectral content thereof and means for determining an average amplitude during each of a plurality of time frames within said unvoiced sound.

14. The system for creating a compressed data representation of a human speech utterance according to claim 8, further including means for regenerating a human speech utterance utilizing said compressed data representation.

* * * * *